United States Patent [19]

Berczik

[11] Patent Number: 4,951,735

[45] Date of Patent: Aug. 28, 1990

[54] MELTING AND CASTING OF BETA TITANIUM ALLOYS

[75] Inventor: Douglas M. Berczik, Palm Beach, Fla.

[73] Assignee: United Technologies Corporation, Hartford, Conn.

[21] Appl. No.: 815,607

[22] Filed: Jan. 2, 1986

[51] Int. Cl.[5] ..... B22C 1/00

[52] U.S. Cl. ..... 164/138; 75/621; 420/421

[58] Field of Search ..... 164/138, 133; 420/421, 420/424, 428; 75/65 R, 84, 621

[56] References Cited

U.S. PATENT DOCUMENTS

| | | | |
|---|---|---|---|
| 2,754,203 | 7/1956 | Vordahl | 420/421 |
| 2,797,996 | 7/1957 | Jaffee | 420/421 |
| 3,131,059 | 4/1964 | Kaarlela | 420/421 |
| 3,598,168 | 8/1971 | Clark | 420/421 |
| 3,986,868 | 10/1976 | Crossley | 420/421 |
| 4,040,845 | 8/1977 | Richerson et al. | 106/38.9 |
| 4,197,643 | 4/1980 | Burstone et al. | 420/421 |
| 4,244,743 | 1/1981 | Blackburn et al. | 106/55 |
| 4,296,793 | 10/1981 | Yasinsky et al. | 164/527 |
| 4,482,398 | 11/1984 | Eylon et al. | 148/11.5 |

OTHER PUBLICATIONS

Busch et al, "The Manufacture of Ductile Titanium", Titanium Project Navy Contract No. Noa(s) 8698, Report No. 7, 10/47.

*Primary Examiner*—Stephen J. Lechert, Jr.
*Attorney, Agent, or Firm*—Charles E. Sohl

[57] ABSTRACT

Improved technology for the melting and casting of a particular class of true beta-type titanium alloys is described. A typical alloy is titanium—35% vanadium—15% chromium. By providing carbon surfaces for contacting molten beta titanium alloys of this type improved melting and casting procedures are effectuated.

2 Claims, No Drawings

MELTING AND CASTING OF BETA TITANIUM ALLOYS

TECHNICAL FIELD

The invention relates to the melting and casting of beta titanium alloys in low reactivity crucibles and molds.

BACKGROUND ART

Conventional titanium alloys are highly reactive, particularly when molten. The extreme reactivity of molten titanium alloys has required that the melting and casting of such alloys be carried out using skull techniques. In melting titanium using a skull technique a water cooled copper container is provided and the melting of the titanium alloY takes place under conditions which provide for solidification of an initial layer of the titanium composition on the water cooled copper chill surfaces so that the molten titanium alloy contacts only solid titanium rather than the copper container itself. Such techniques are necessary because of the reactivity of titanium but are also desirable because the molten product is free from contamination. Skull melting techniques have drawbacks including the limitation on the amount of superheat which is a consequence of the necessity of maintaining a solid skull between the molten material and the copper shell plate. In practice this leads to the requirement that the superheat in the molten titanium be not greater than about 40° F. This limitation on superheat in turn can lead to casting problems relating to a lack of fluidity in the molten titanium with such a low superheat. The limitation to low superheat means that complex titanium castings are very difficult to produce so that most complex titanium shapes are produced by forging, an expensive process.

The reactivity between pure titanium and commercial titanium alloys and carbon is extremely high as a consequence of the high energy of formation of titanium carbides. In practice this high reactivity and the detrimental effect of carbon contamination on the mechanical properties of the resultant alloys have required that carbon be excluded from contact with molten titanium.

Recently a new class of Beta titanium alloys has been developed. These alloys are described in U.S. patent applications Ser. No. 948,390 filed Dec. 23, 1986 and U.S. Ser. No. 004,206 filed Dec. 23, 1986 which are continuations-in-part of Ser. No. 815,606, filed Jan. 2, 1986, now abandoned and are comprised of major constituents titanium, vanadium and chromium with an example alloy being Ti-35% vanadium - 15% chromium. Despite being formed from alloy constituents which all are energetic carbide formers it is a surprising observation that alloys of the approximate composition described above are relatively nonreactive with carbon.

DISCLOSURE OF INVENTION

This invention relates to the melting and casting of beta titanium alloys of a particular class of compositions using melting and casting apparatus having molten metal contacting surfaces which are formed essentially of carbon. It has been found that a certain class of beta titanium alloys is relatively nonreactive with carbon and so can be advantageously processed in contact with carbon. Further, it has been determined that amounts of carbon which are dissolved by the alloy are not deleterious to the material properties and in fact under some circumstances may be advantageous.

The foregoing and other objects, features and advantages of the present invention will become more apparent from the following description of the preferred embodiments.

BEST MODE FOR CARRYING OUT THE INVENTION

The invention relates to the technology for melting and casting beta titanium alloys which consists of more than 10% chromium, more than 20% vanadium, and at least 40% titanium. Such alloys are the subject of U.S. patent application, Ser. No. 815,606 filed on even date herewith, now abandoned the contents of which are incorporated by reference. These alloys have a notable combination of strength and incombustibility under the moderately severe conditions which are encountered in the turbine section of gas turbine engines.

It has been found that such materials can readily be contacted with carbon in various forms while the alloy material is molten without undue adverse reactions. Thus, for example, the alloy may be melted in a graphite crucible and the crucible can be inductively heated using the well-known properties in graphite as a susceptor without undue reaction with the graphite. Use of carbon base crucible with the previously described beta titanium alloys can eliminate the necessity for and disadvantages of the skull melting techniques used heretofore.

In fact it has been observed that the beta alloy material appears to reach an equilibrium carbon content which is related to the degree of superheat of the material. Thus, for an example, material with a negligible amount of superheat (i.e., very close to the freezing point) will contain an equilibrium amount of carbon on the order of 0.1–0.3%. At 100° superheat the material will contain an equilibrium amount of carbon on the order from 0.4 to 0.6 weight percent. At 200° it is estimated that the material will contain an amount of carbon from 0.6 to 1.2% by weight.

The implications of the present invention are particularly apparent in the casting process. Whereas in the prior art it has been difficult if not impossible to cast to size complex titanium articles having close geometry because of mold metal reactions, and low superheat with the present invention it is possible to form a complex carbon mold, for example by machining graphite by coating a ceramic mold with carbon (e.g., pyrolytic graphite) or by using investment shell mold techniques but wherein the inner metal contacting stucco and slurries are comprised essentially of carbon. or by using investment casting techniques wherein the metal contacting surfaces are formed from carbon particles bonded with colloidal silica or colloidal alumina or other titanium shell system. This will permit the casting of complex shapes such as gas turbine engine components having a casting surface free from mold metal attack and a highly precise geometry which will minimize the necessity for further machining.

It should be understood that the invention is not limited to the particular embodiments shown and described herein, but that various changes and modifications may be made without departing from the spirit and scope of this novel concept as defined by the following claims.

I claim:

1. A method of casting titanium alloy articles of the type based on Ti-V-Cr and containing more than about 10% Cr, more than about 20% V and more than about 40% Ti which comprises a. melting the alloy in a crucible having a carbon metal contacting surface, and without formation of a titanium skull;

b. applying sufficient energy to heat the molten alloy to the desired superheat;

c. casting said controlled superheat titanium alloy into a mold having a metal contacting surface which is essentially carbon.

2. In the melting and casting of alloys which contain more than about 10% Cr, more than about 20% V and more than about 40% Ti, and are comprised essentially of beta titanium, the improvement which comprises providing at least a surface coating of essentially carbon on all surfaces which contact the molten alloy.

* * * * *